US006904863B2

(12) United States Patent
Mardikian et al.

(10) Patent No.: US 6,904,863 B2
(45) Date of Patent: Jun. 14, 2005

(54) SELF-RETRACTING LOCKABLE STEP-ASSEMBLY FOR BOATS

(75) Inventors: Albert Mardikian, Corona Del Mar, CA (US); Raffi Pinedjian, Fountain Valley, CA (US); Aaron Delaby, Carlsbad, CA (US)

(73) Assignee: The Mardikian Family Trust, Corona Del Mar, CA (US)

( * ) Notice: Subject to any disclaimer, the term of this patent is extended or adjusted under 35 U.S.C. 154(b) by 0 days.

(21) Appl. No.: 10/892,713

(22) Filed: Jul. 16, 2004

(65) Prior Publication Data

US 2005/0016439 A1 Jan. 27, 2005

Related U.S. Application Data

(60) Provisional application No. 60/489,823, filed on Jul. 23, 2003.

(51) Int. Cl.[7] ..... B63B 17/00
(52) U.S. Cl. ..... 114/362
(58) Field of Search ..... 114/362; 14/71.1; 182/64.1, 69.4, 237

(56) References Cited

U.S. PATENT DOCUMENTS 3,532,067 A * 10/1970 Baker et al. ..... 114/279
4,926,965 A * 5/1990 Fox ..... 182/89
4,993,341 A * 2/1991 Merkel ..... 114/61.1
5,085,165 A * 2/1992 Reed ..... 114/362
5,152,244 A 10/1992 Jarmillo, Jr.
5,427,049 A 6/1995 Mardikian
5,458,080 A 10/1995 Jaramillo, Sr.
5,632,591 A * 5/1997 Henriquez ..... 414/462
5,927,433 A 7/1999 Jaramillo, Sr.
6,125,491 A * 10/2000 Alexander ..... 14/69.5

* cited by examiner

*Primary Examiner*—Stephen Avila
(74) *Attorney, Agent, or Firm*—Gabor L. Szekeres

(57) ABSTRACT

A self-retracting step assembly is attached to a swimming platform provided on the rear of the hull of a boat. The self-retracting step assembly includes a ladder comprising a series of telescoping tubes which enable its extension and retraction. The step assembly including the ladder assembly are attached to the swimming platform in a position in which the ladder is capable of extending into the water wherein the watercraft or boat floats. The telescoping ladder assembly can be extended and placed from a normally horizontal position into an inclined position wherein at least the last step of the ladder reaches the water. The energy for extending the ladder is supplied by a human user. The step assembly includes a motor or mechanical means for storing the energy used for extending the ladder. The ladder assembly is locked into the extended and inclined position by an improved mechanism that is located within the assembly attached to the swimming platform. Retraction of the ladder assembly is triggered by a change in the angle of the ladder relative to the water, said change being triggered by force of the water relative to the ladder when the watercraft or boat moves. The energy utilized for the retraction is preferably the stored energy of the extension, or it can be supplied by a motor.

20 Claims, 8 Drawing Sheets

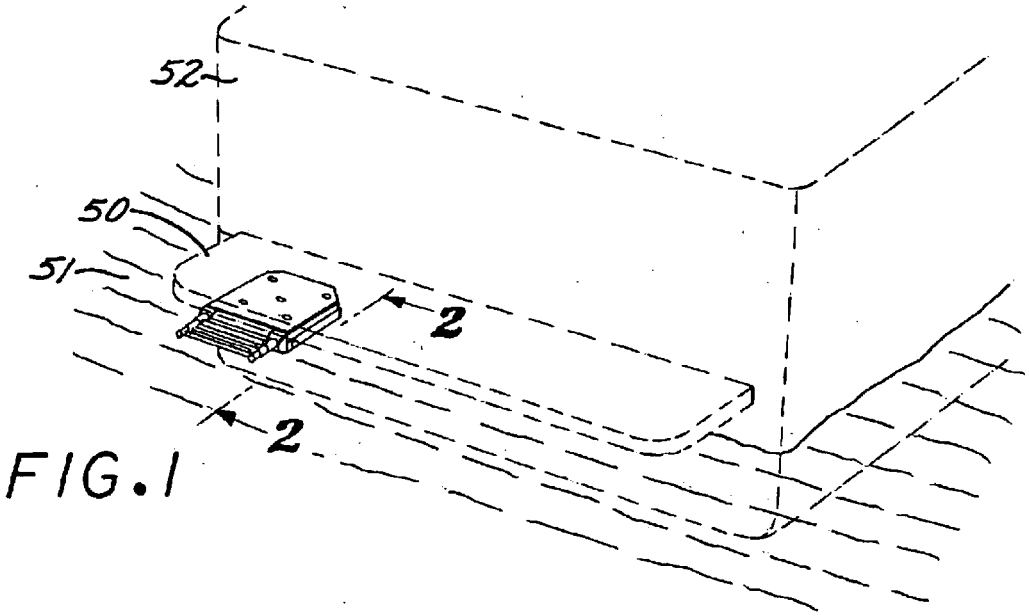
FIG. 1
FIG. 2
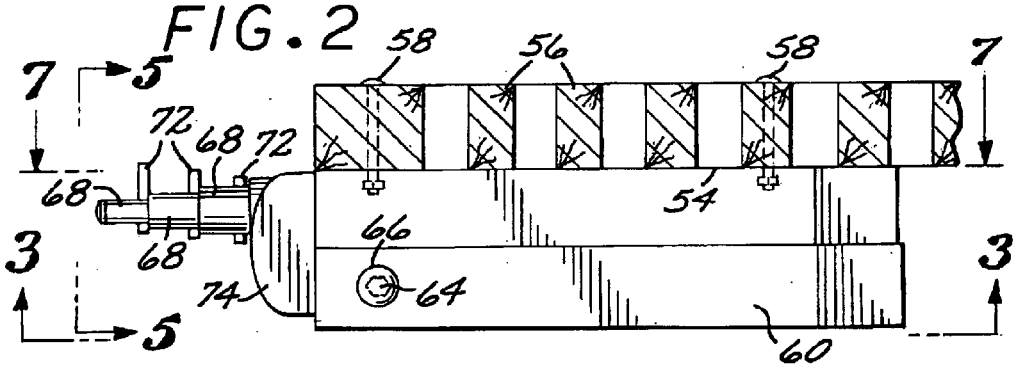
FIG. 3
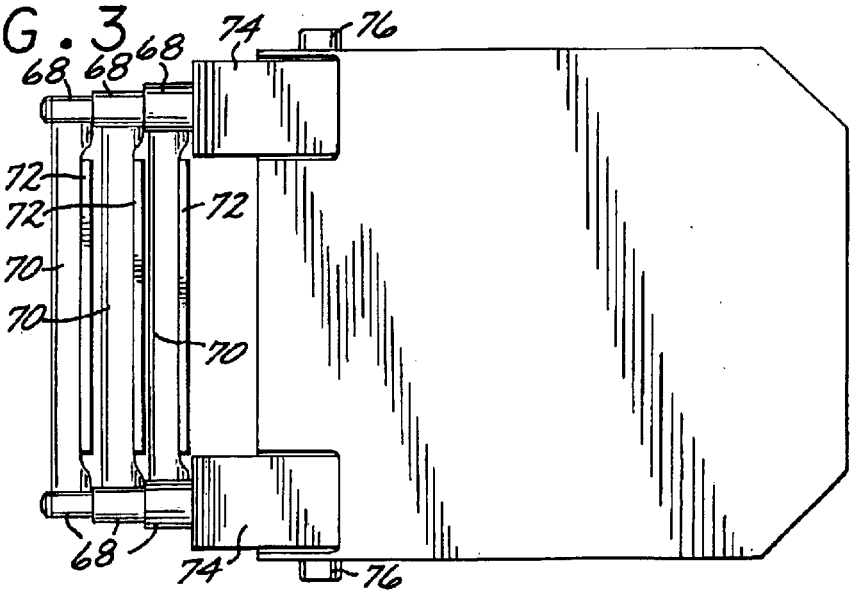

FIG. 17
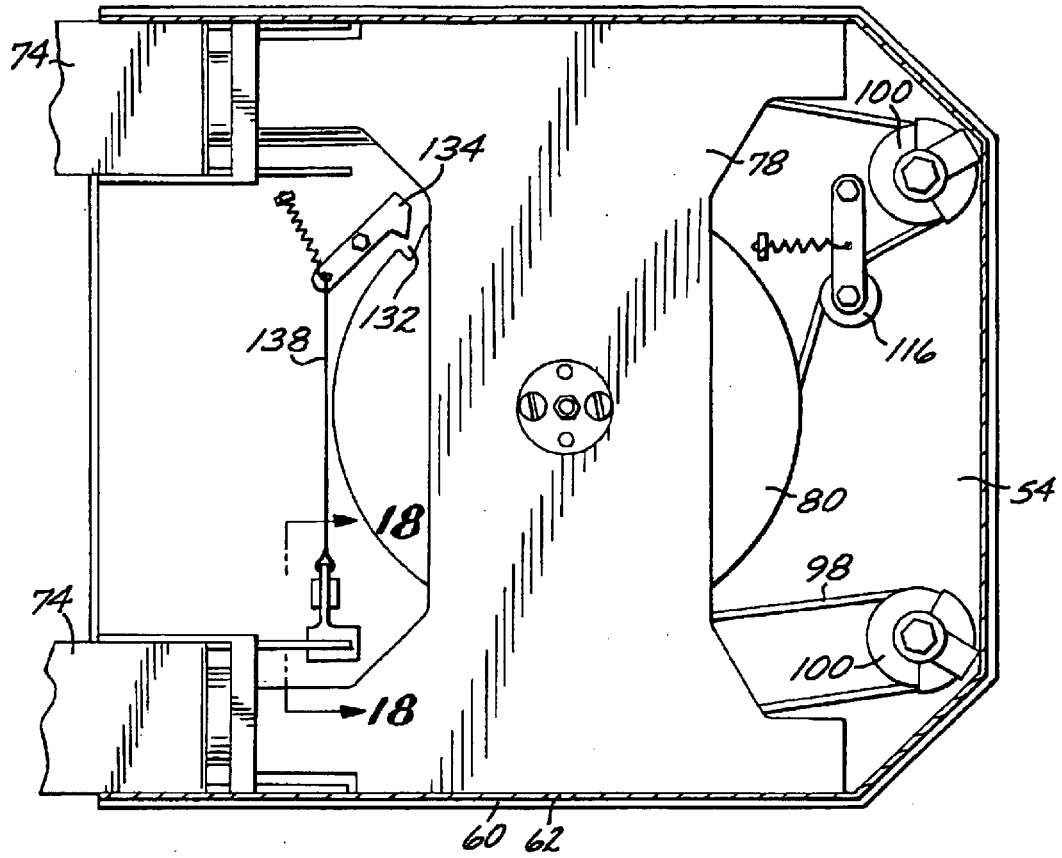
FIG. 18
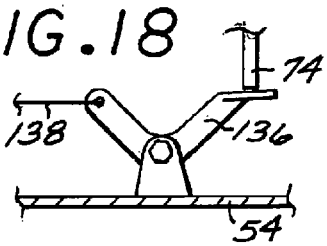
FIG. 19
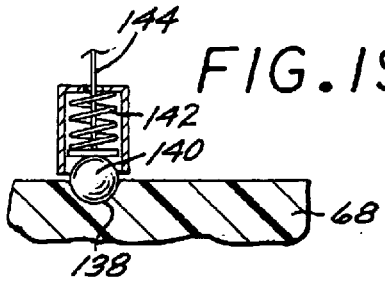
FIG. 20
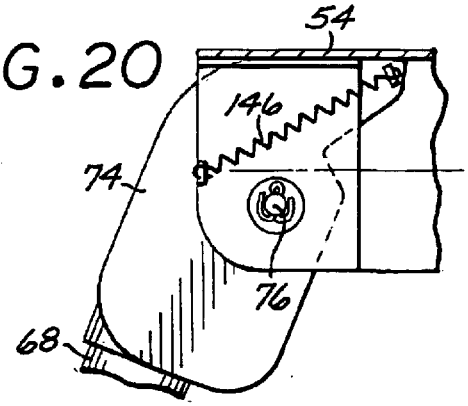
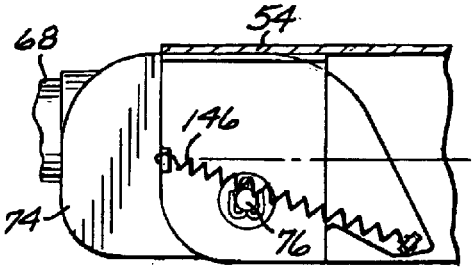
FIG. 21

SELF-RETRACTING LOCKABLE STEP-ASSEMBLY FOR BOATS

CROSS-REFERENCE TO RELATED APPLICATION

The present application claims the priority of U.S. provisional application Ser. No. 60/489,823, filed on Jul. 23, 2003.

BACKGROUND OF THE INVENTION

1. Field of the Invention

The present invention is directed to a step assembly which is mounted to a swimming platform in the rear of a watercraft or boat, such as a pleasure boat, and which can be extended and locked when the watercraft or boat is essentially motionless to allow persons to descend into the water or ascend into the watercraft or boat, and which retracts when the watercraft or boat is in forward motion in the water.

2. Brief Description of the Prior Art

Boats and ships are well known in the art. Many boats, primarily motor and sailboats used for pleasure include a swimming platform mounted to the rear of the hull. The swimming platform usually has a horizontal surface unto which a person can step prior to entering the water that floats the boat. Generally speaking, it is difficult for most persons to enter the water directly from the swimming platform and even more difficult, often virtually impossible, for the average person to ascend to the swimming platform from the water. For this reason the prior art provided ladders which can be lowered from the swimming platform into the water and which render it easier for a person to enter into and exit from the water. For several reasons it is usually considered undesirable to leave such ladders in the water when the boat is in motion, therefore the ladder is usually retracted before, or soon after, the boat begins moving. The prior art ladders utilized for this purpose, generally speaking, require extension and retraction by entirely manual operation. This involves manually folding the ladder downward when the ladder is placed into the water and the reverse manual operation when the ladder is retracted.

U.S. Pat. No. 5,427,049 describes a self-retracting ladder assembly to be utilized in connection with personal watercraft. This ladder assembly is mounted underneath the riding platform of the personal watercraft and its surfaces are exposed to the thrust of the water generated by the jet pump. The ladder assembly of U.S. Pat. No. 5,427,049 functions reasonably well when used on personal watercraft powered by a jet pump.

Other step or ladder assemblies used on boats are described in U.S. Pat. Nos. 5,152,244, 5,458,080 and 5,927,433. In spite of the availability of these prior art step or ladder assemblies an improvement of the prior art is needed for boats where the rear of the hull includes a swimming platform. The self-retracting step assembly of the present invention provides such improvement.

OBJECTS AND SUMMARY OF THE INVENTION

It is an object of the present invention to provide a self-retracting step assembly mounted to the swimming platform of a boat which can be used to facilitate getting into the water from the boat and climbing aboard the boat from the water.

It is another object of the present invention to provide a step assembly which meets the following objective and which includes an improved mechanism to lock a ladder into an extended and inclined position wherein at least a last step of the ladder is in the water.

It is still another object of the present invention to provide a step assembly which meets the foregoing objectives and wherein retraction of the ladder is automatically triggered by forward movement of the boat in the water.

The foregoing and other objects and advantages are attained in accordance with the present invention by a self-retracting step assembly which is attached to a swimming platform provided on the rear of the hull of a boat. The self-retracting step assembly includes a ladder comprising a series of telescoping tubes which enable its extension and retraction. The step assembly including the ladder assembly are attached to the swimming platform in a position in which the ladder is capable of extending into the water wherein the watercraft or boat floats. The telescoping ladder assembly can be extended and placed from a normally horizontal position into an inclined position wherein at least the last step of the ladder reaches the water. The energy for extending the ladder is supplied by a human user or by a motor. The step assembly includes the motor or mechanical means for storing the energy used for extending the ladder. The ladder assembly is locked into the extended and inclined position by an improved mechanism that is located within the assembly attached to the swimming platform. Retraction of the ladder assembly is triggered by a change in the angle of the ladder relative to the water, said change being triggered by force of the water relative to the ladder when the watercraft or boat moves. The energy utilized for the retraction is preferably the stored energy of the extension, or it can be supplied by a motor.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 1 is a perspective view showing the self-retracting step assembly mounted to the swimming platform of a boat.

FIG. 2 is a cross-sectional view taken on lines 2,2 of FIG. 1 showing a ladder assembly in a retracted position.

FIG. 3 is a plan view taken on lines 3,3 of FIG. 2 showing the ladder assembly in the retracted position.

FIG. 17 is a view, partly in cross section, similar to the view of FIG. 7 and showing another preferred embodiment of the invention.

FIG. 18 is a view, partly in cross section, taken on lines 18,18 of FIG. 17.

FIG. 19 is a schematic view of the locking mechanism of still another preferred embodiment.

FIGS. 20 and 21 are schematic views showing yet another preferred embodiment wherein a tension spring provides force to move the ladder assembly into a horizontal position.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventors for carrying out their invention in a commercial environment, although it should be understood that various modifications can be accomplished within the parameters of the present invention.

Figure 33:
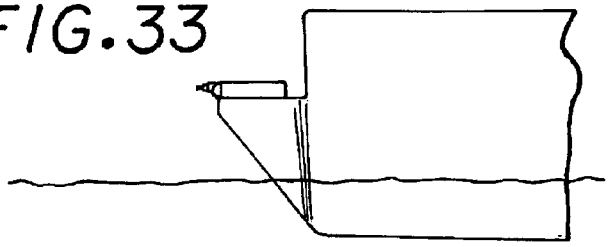
FIG. 33 is a schematic view showing the self-retracting step assembly mounted above the swimming platform of a boat.

Referring now to the drawing figures the novel self-retracting step assembly of the present invention is disclosed. The novel step assembly of the present invention is mounted to the swimming platform 50 of boats 52. It is well known in the art that many boats, primarily the boats used for pleasure, include such swimming platforms 50 onto which a person may step when he or she desires to enter the water 51. The novel step assembly of the present invention is designed to be attached to the underside of the swimming platform 50. Nevertheless, in modern boats wherein the hull includes a swimming platform 50 that has no horizontally disposed bottom surface the novel step assembly of the invention can be attached to the upper surface of the swimming platform 50. This is shown in FIG. 33 of the attached drawings.

FIGS. 1 through 16 disclose the first preferred embodiment of the novel step assembly of the present invention in detail. The step assembly includes a base plate 54 that is attached to cross-members 56 of the swimming platform 50 by a bolts and nuts assembly 58. The step assembly also includes a cover 60 which is preferably made of fiberglass or plastic material. The cover 60 can be attached to side plates 62 of the step assembly by bolts and nuts, but in the preferred embodiment the bolt 64 that attaches the cover 60 to the side plates 62 includes a boss 66 into which the bolt 64 is fitted.

The working mechanism of the self-retracting step assembly of the invention is contained in part within the box-like structure that is formed by the base plate 54, side plates 62 and cover 60. The working mechanism includes a ladder assembly that includes a pair of plurality of telescoping tubular members 68. Because of their telescoping nature the telescoping members 68 can be extended and retracted. Each pair of the telescoping members 68 is disposed substantially parallel with the respective side plates 62 of the step assembly so that when the telescoping members 68 are extended they form a U-shaped structure. Cross bars or rungs 70 are attached between the telescoping members 68 and a substantially flat, substantially rectangular member 72 is mounted to each cross bar or rung 70. The substantially flat rectangular members 72 serve as steps when a person (not shown) utilizes the ladder assembly for entering or coming out of the water 51 and into the boat 52. In the herein described first preferred embodiment the tubular telescoping members 68 and the rungs 70 are made of steel and the rungs 70 are welded to the telescoping members 68. The rectangular members 72 which serve as steps are preferably made of fiberglass or plastic material and are attached to the rungs 70 by screws or bolts (not shown). In the preferred embodiments of the invention each pair of the telescoping members 68 has three tubes of successively smaller diameter, three rungs 70 interconnect the telescoping members 68 and one step 72 is mounted to each rung 70.

The first or largest of the tubular members 68 on each side of the step assembly is attached to a pivot block 74 shown in several of the drawing figures and perhaps best shown in FIGS. 8, 11, 12, and 13. Each pivot block 74 is attached to the respective side plate 62 of the step assembly on a hinge that is formed by a bolt 76. The portion of the pivot block 74 that faces the interior of the step assembly is formed in a shape that cooperates with the mechanism or means that locks the ladder assembly in an extended and inclined position when the boat 52 is motionless in the water. The parts and operation of this mechanism or means are described below with primary reference to FIG. 7.

Figures 4, 5, 6:
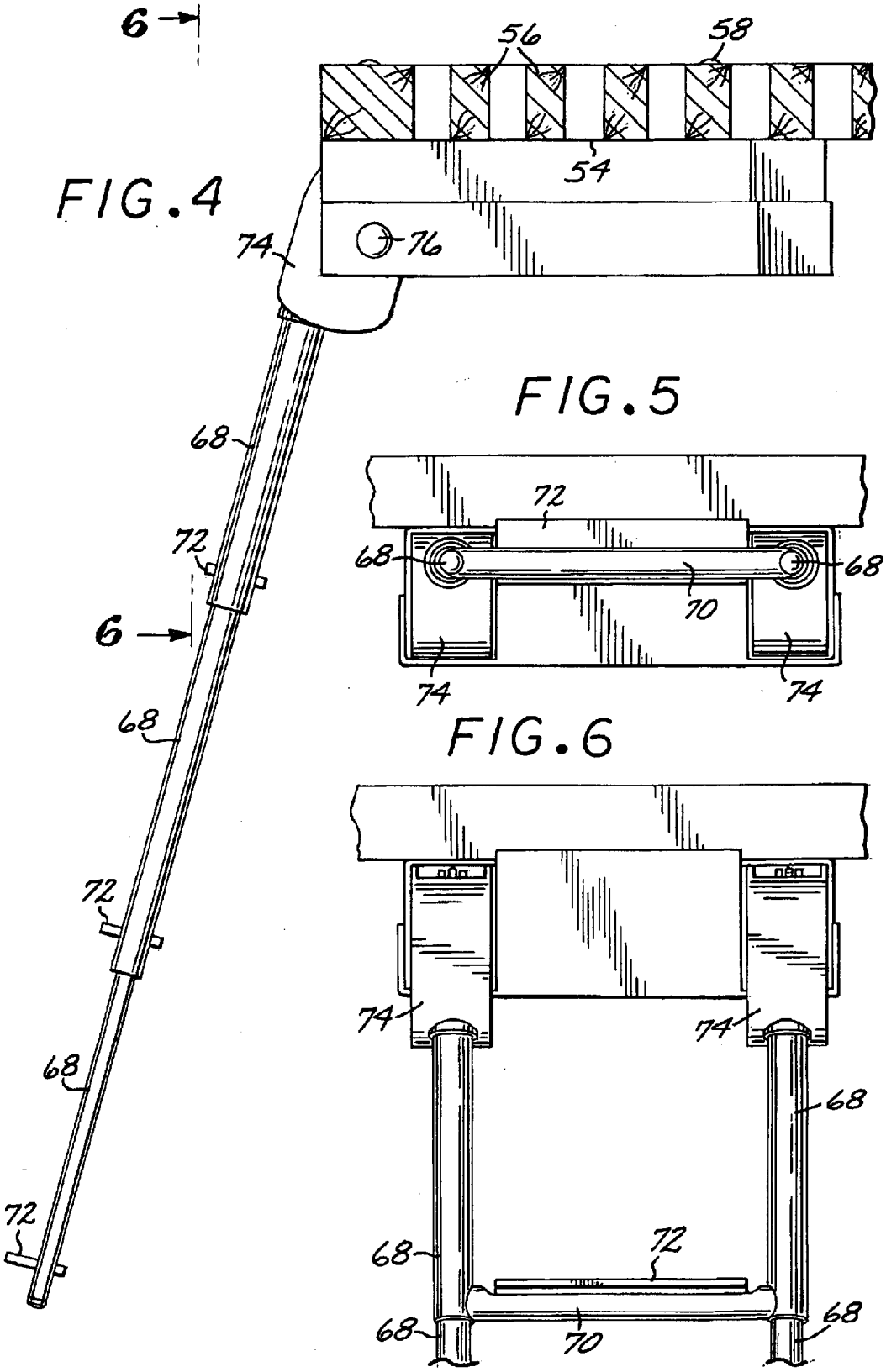
FIG. 4 is a plan view similar to the one taken on lines 3,3 of FIG. 2 showing the ladder assembly in an extended and inclined position.
FIG. 5 is a plan view taken on line 5,5 of FIG. 2.
FIG. 6 is a plan view taken on lines 6,6 of FIG. 4 showing the ladder assembly in the extended and inclined position.
Figure 7:
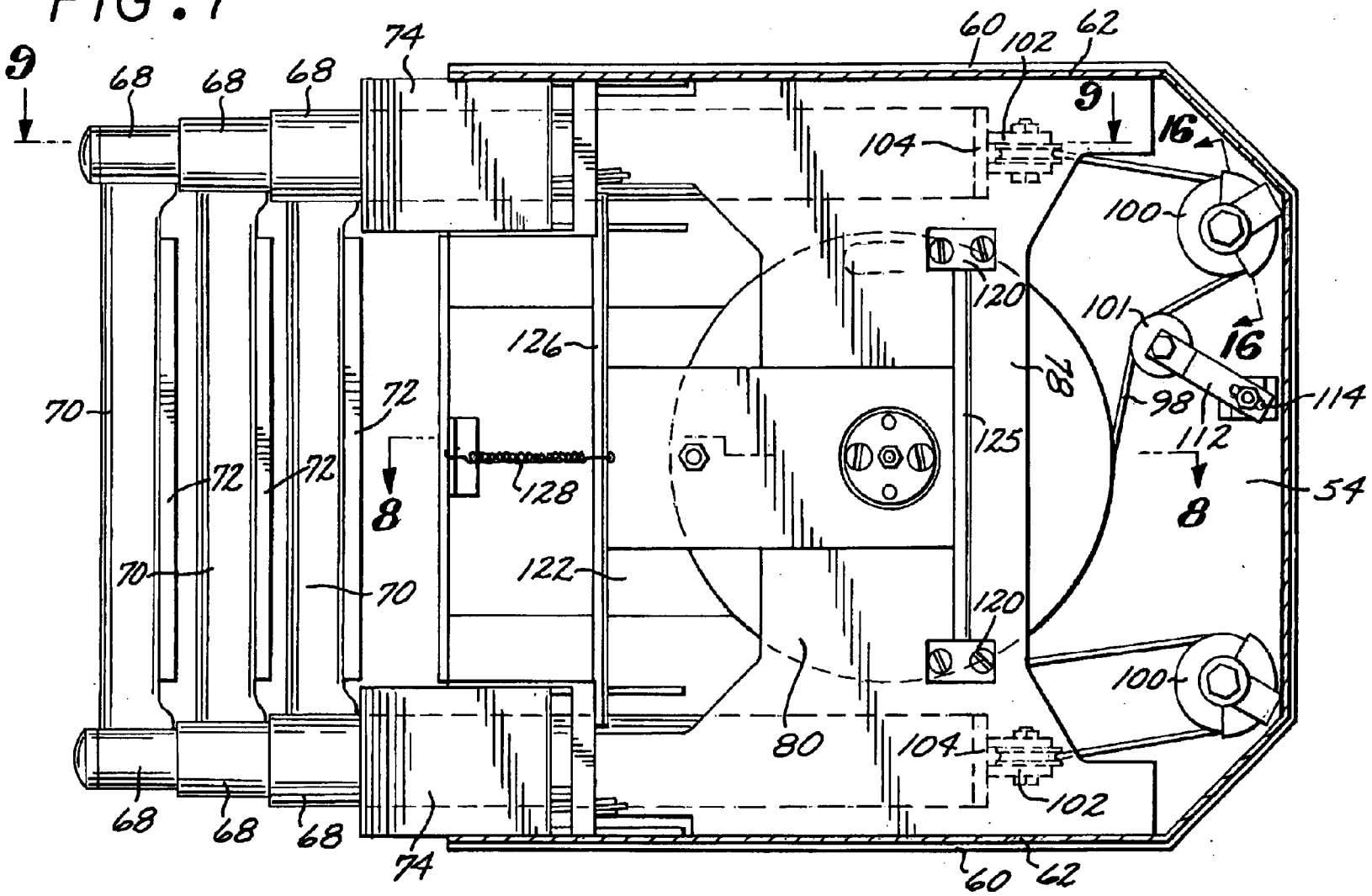
FIG. 7 is a view, partly in cross section, taken on lines 7,7 of FIG. 2, showing the ladder assembly in the retracted position.
Figure 8:
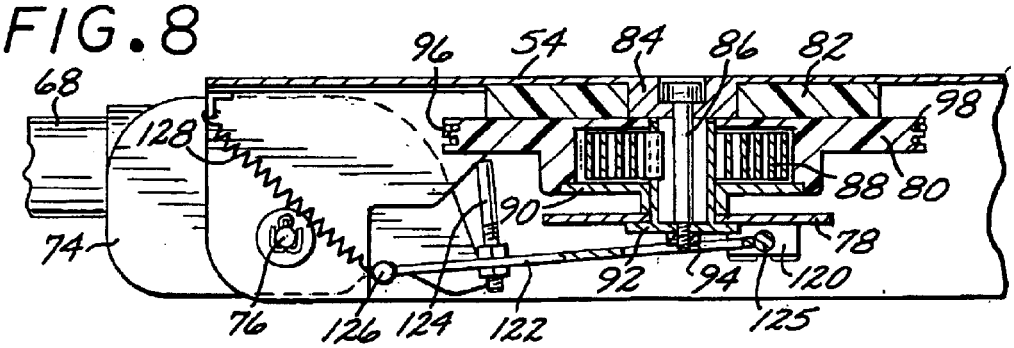
FIG. 8 is a view, partly in cross section, taken on lines 8,8 of FIG. 7.
Figure 11:
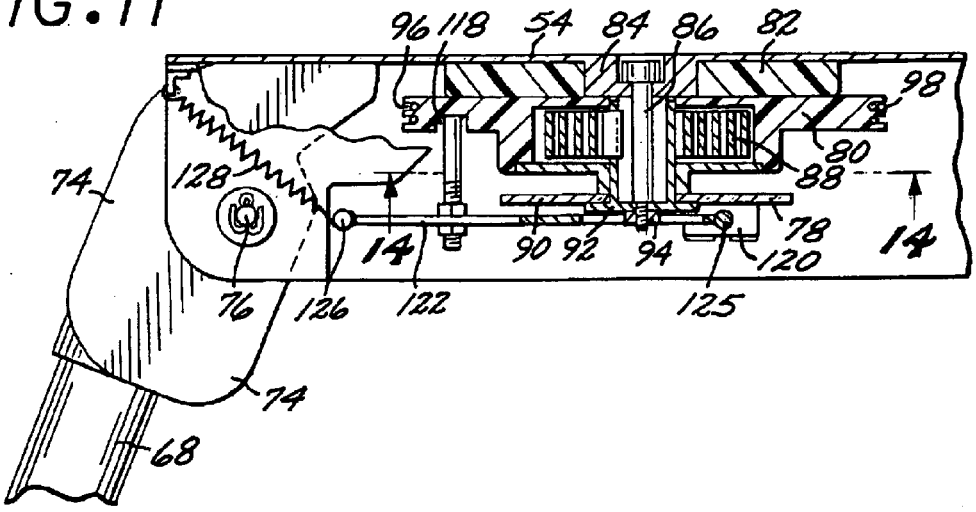
FIG. 11 is a view, partly in cross section, similar to the one taken on line 8,8 of FIG. 7 and showing the ladder assembly in the extended and inclined position.

Referring now primarily to FIG. 7 a cross member or cross plate 78 is mounted between the side plates 62. The cross plate 78 serves as a brace to reinforce the substantially box shaped structure formed by the base plate 54 and side plates 62. A reel or spool 80 is mounted in the space between the base plate 54 and the reinforcing cross plate or brace 78. The spool 80 and its mounting to the base plate 54 are best shown in FIGS. 8 and 11. Proceeding in the description from the top of FIG. 8 downward, first a round spacer 82, preferably made of plastic materials is attached to the base plate 54. One function of the round spacer 82 is to keep the spool 80 from wobbling. A boss 84 is attached, preferably by welding to the underside of the base plate 54 and the rotational axle 86 of the spool 80 is embedded in the boss 86. The rotational axle 86 is in fact a shoulder bolt. A torsional spring 88 is disposed within a hollow space provided in the spool 80 and a flange 90 encloses the interior of the spool 80. Below the flange 90 is the cross brace 78, a washer 92 and a nut 94 that is placed on the shoulder bolt 86 whereby the spool 80 is solidly held and is nevertheless capable to rotate within the above described assembly.

Figure 9:
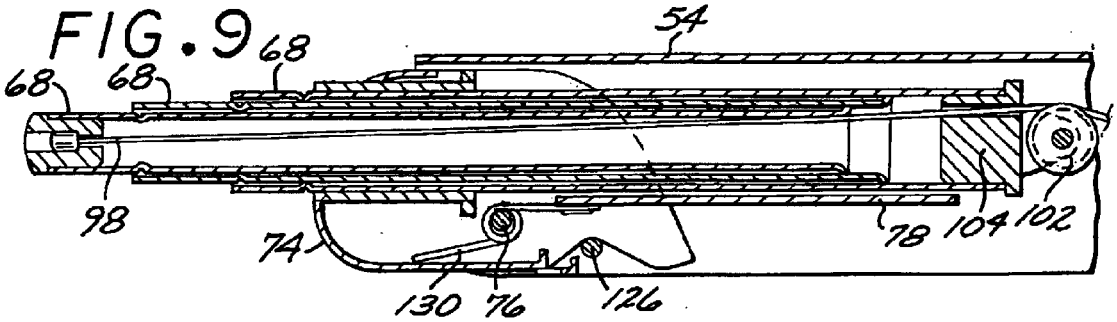
FIG. 9 is a view, partly in cross section, taken on lines 9,9 of FIG. 7 showing the ladder assembly in the retracted position.
Figure 10:
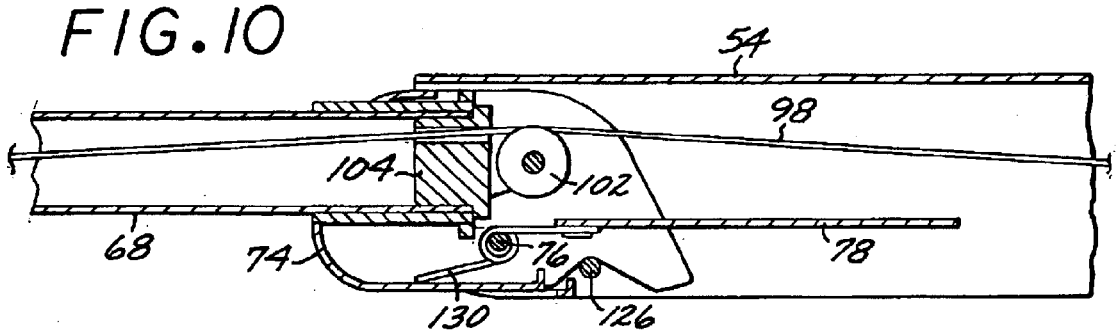
FIG. 10 is a view, partly in cross section, similar to the one taken on line 9,9 of FIG. 7 and showing the ladder assembly in the extended position.

The circumference of the spool 80 includes a groove 96 in which a cable 98 rides. From the spool 80 the cable 98 is led through two pulleys 100 and a tensioner pulley 101 into the interior of each of the pair of telescoping tubular members 68. Each end of the cable 98 is attached to the respective end of the last telescoping member 68 that has the smallest diameter among the three telescoping members 68. A pulley 102 is attached to a flange 104 provided in each of the first telescoping members 68, namely the ones that have the largest diameter. Thus, the cable 98 is wrapped around the spool 80 and rides in its groove 96 and also rides over the two pulleys 100, the tensioner pulley 101 and the pulleys 102 attached to the flanges 104. Placement of the cable 98 within the interior of the tubular members 68 and attachment of the ends of the cable 98 to the last of the tubular members 68 is best shown in FIG. 9. The flanges 104 also serve to prevent the first of the tubular members 68 from being pulled out of the assembly, as is shown in FIG. 10. Each of the remaining tubular members 68 have a flange or flared end in their interior to prevent the members 68 from being pulled out from each other.

Figure 16:
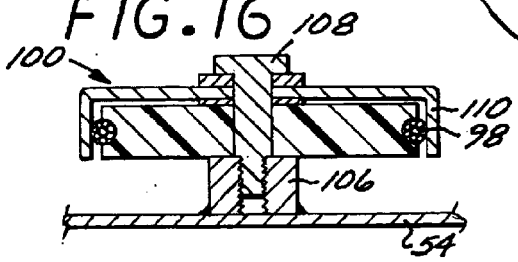
FIG. 16 is a cross-sectional view taken on lines 16,16 of FIG. 7.

Detailed construction of the pulleys 100 of the herein described preferred embodiment is disclosed by FIG. 16. Each pulley 100 is mounted within a boss 106 welded to the base plate 54 on an axle formed by a bolt 108 and includes a retainer 110 which prevents the cable 98 from falling out of the groove of the respective pulley 100. The herein described pulleys 100 and 101 are not self-adjusting to compensate for stretching of the cable 98. Nevertheless the pulley 101 in the middle among the three in the herein described preferred embodiment can be adjusted to compensate for stretching of the cable 98 that may occur after prolonged use. As it is shown in FIG. 7, this tensioner pulley 101 is mounted on a plate 112 that includes a slot 114. When adjustment is needed the plate 112 is moved further on its mounting, as permitted by the slot 114. A tensioner pulley 116 that is spring loaded and therefore self-adjusts for stretching of the cable 98 is shown in FIG. 17 in connection with an alternative embodiment.

It should be already apparent from the foregoing description and inspection of the drawing figures that a user (not shown) can manually extend the three tubular members 68 of the ladder assembly by pulling the last member with a force that overcomes the force of the torsional spring 88 within the spool 80. By virtue of the cable 98 being disposed in the groove 96 of the cable 98 the spool 80 rotates while the tubular members 68 are pulled out. In this process the torsion spring 88 is wound and, as a result, stores the energy expanded by the user (not shown) who extends the tubular members 68. After the tubular members 68 have been pulled out in a horizontal or substantially horizontal direction the extended ladder assembly is rotated, still by the force of the human user (not shown), about the hinges or axles formed by the bolt 76, into an inclined position. In the inclined position at portion of the ladder assembly is in the water 51. In this inclined position of the ladder assembly a person (not shown) can utilize the ladder assembly to enter into or exit from the water 51.

In the prior art extendible and self-retracting ladder and step assembly of U.S. Pat. No. 5,427,049 there are camming surfaces which more or less correspond to the position of the pivot blocks 74 of this invention, and these camming surfaces tend to lock the extended ladder of that disclosure in an inclined position, until motion of the watercraft or boat tilts the ladder upward and the ladder is retracted by the force of a spring. The step assembly of this invention comprises a significantly improved locking mechanism which is best shown for the first preferred embodiment in FIGS. 8 and 11–15. Thus, the underside of the spool 80 includes a ramped recess that serves as locking channel 118. Two bosses 120 are mounted to the underside of the cross plate or brace 78 and a plate 122 carrying a bolt 124 is mounted on an axle 125 which is held by the two bosses 120. The bolt 124 serves as a spool locking pin. The two bosses 120 and the axle 125 held by them is also shown in FIG. 7. By virtue of being mounted on the axle 125 the plate 122 is capable of some pivoting movement. A rod 126 is attached to the plate 122 in a position which is transverse to the longitudinal axis of extension of the three tubular members 68. The rod 126 is biased, that is being pulled towards the base plate 54 of the assembly by a tension spring 128 that is mounted both to the base plate 54 and to the rod 126.

For operation of the locking mechanism the rear ends of the two pivot blocks 74 interface with the rod 126. In the retracted position of the tubular members 68 shown in FIG. 8 the rear ends of the pivot blocks push the plate 122 downward against the biasing force of the tension spring 128. In this position of the tubular members 68 the spool locking pin or bolt 124 carried on the plate 122 is not in the locking channel 118 of the spool 80, nor is the locking channel 118 in a position facing the spool locking pin 124.

When the tubular members 68 are fully, or substantially fully, extended then, due to the rotation of the spool 80, the recess forming the locking channel 118 in the underside of the spool 80 occupies a position facing the spool locking pin 124. The ramp and stop shape of the locking channel 118 (shown in FIG. 15) allows for multiple rotation of the spool 80 before the pin 124 is locked in the channel 118. When the extended tubular members 68 are rotated downward to occupy an inclined position then the rear ends of the pivot blocks 74 disengage the rod 126 of the plate 122 and the biasing force of the tension spring 128 pulls the spool locking pin 124 into the locking channel 118. This is shown in FIG. 11. In this inclined position of the tubular members 68, the tubular members 68 are locked into the extended and inclined position. This is the position in which the ladder assembly is used by persons wishing to go into the water 51 or ascend to the swimming platform 50 of the boat 52.

Figure 12:
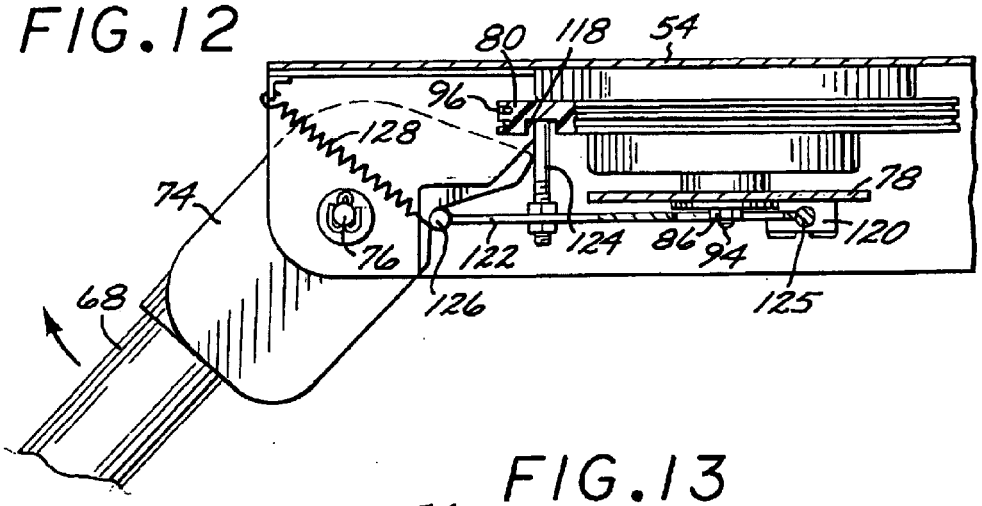
FIG. 12 is a view, partly in cross section, similar to the one taken on line 8,8 of FIG. 7 and showing the ladder assembly moving up from the extended and inclined position.
Figure 13:
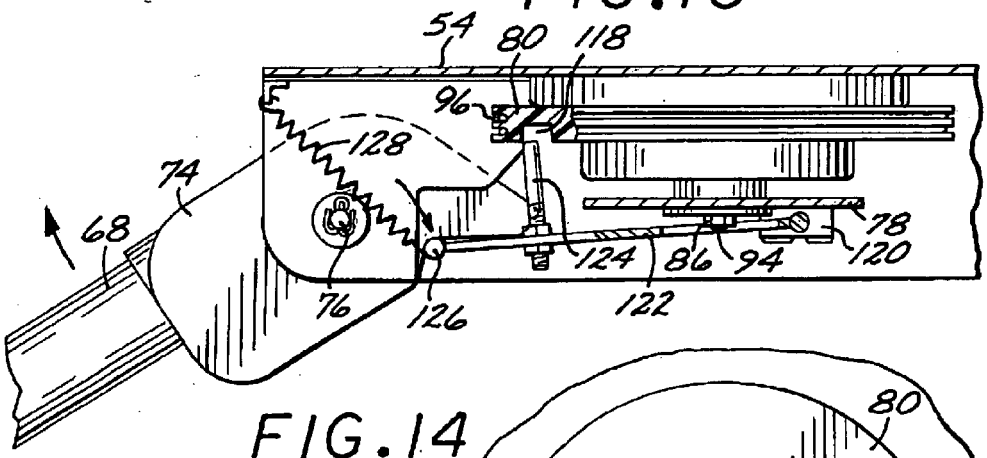
FIG. 13 is a view, partly in cross section, similar to the one taken on line 8,8 of FIG. 7 and showing the ladder assembly moving still further up from the extended and inclined position.
Figure 14:
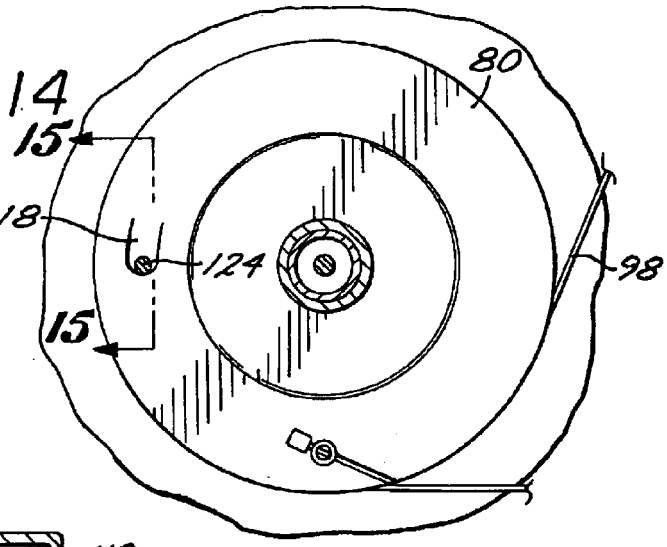
FIG. 14 is a view, partly in cross-section showing the cable spool of the first preferred embodiment in detail.
Figure 15:
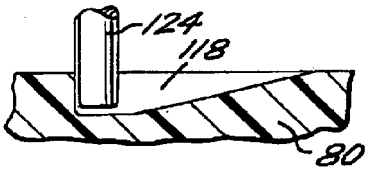
FIG. 15 is a cross-sectional view taken on lines 15,15 of FIG. 14.

It should be apparent to those skilled in the art in light of the foregoing description and the drawing figures that rotation of the extended tubular members 68 about the axles 76 reverses the above described process, as is shown in FIGS. 12 and 13. During this reverse process the rear ends of the pivot blocks 74 come into contact with the rod 126 and push the plate 122 downward and thereby pull the spool locking pin 108 out of the spool locking channel 118. Torsion springs 130 mounted within the pivot blocks 74 on the axles 76 engage the cross brace 78 and the interior of the blocks 74. These provide a force tending to place the tubular members 68 into the upward position wherein they are retracted by the cable 98 which is wound up on the spool 80 under the force of the torsional spring 88 inside the spool 80.

Upward rotation of the extended and inclined telescoping members 68 can be initiated by human force. More importantly in accordance with the present invention it is automatically initiated when the boat 52 moves forward relative to the water 51. This is because the portions of the ladder assembly in the water 51 act as a hydrofoil and result in a force that rotates upward the extended tubular members 68.

Whereas the foregoing description in connection with FIGS. 1 through 16 discloses the presently preferred embodiment, and particularly the presently preferred locking mechanism of the invention, other locking mechanisms still utilizing the cable and spool arrangement can be incorporated in the present invention. For example, FIGS. 17 and 18 disclose another embodiment where the spool 80 has a recess 132 on its circumference and a spring-loaded arm 134 may engage the recess 132 and lock the inclined tubular members 68 into extended and inclined position. FIG. 18 is a schematic representation of a bell crank 136 connected with a cable 138 to the spring-loaded arm 134. When the rear end of the block 74 (shown only schematically in FIG. 18) is in contact with the bell crank 136 then the spring-loaded arm 134 is not in the recess 132 nor is the recess 132 in position to accept the spring-loaded arm 134. FIG. 17 shows this embodiment in the position where the spring-loaded arm 134 is about to engage or about to disengage the recess 132. However, when the rear end of the block 74 no longer pushes against the bell crank 136 then the spring loaded arm 134 engages the recess 132 and locks the ladder assembly.

FIG. 19 schematically discloses still another embodiment for the locking mechanism, wherein a recess 138 is provided in one of the tubular members 68 and ball 140 is pushed under bias of a spring 142 into the recess 138. The bias of the spring 142 is overcome by the pull of a cable 144 which is activated, for example, through a bell crank (not shown for this embodiment) interacting with the rear end of the block 74 when the tubular members 68 are not in the extended and inclined position.

FIGS. 20 and 21 schematically disclose still another embodiment wherein instead of the torsion springs 130 of the first preferred embodiment tension springs 146 are used to assist motion of the extended tubular members 68 from the inclined into the upright position.

Figure 22:
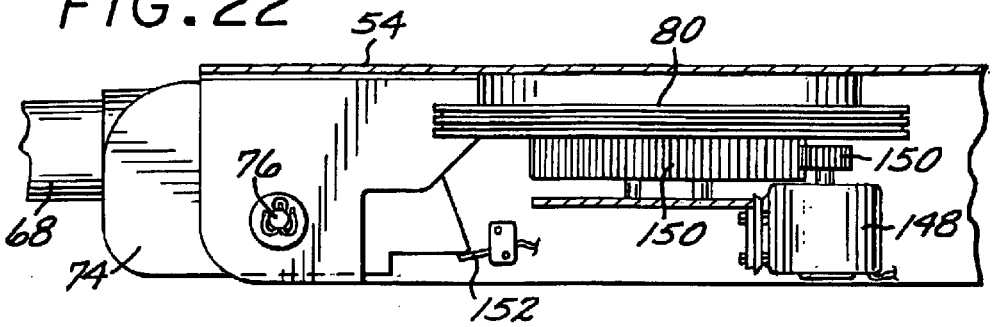
FIG. 22 is a view, partly in cross section, showing a further embodiment of the invention that includes a motor for retracting the ladder assembly.

FIG. 22 schematically discloses still another embodiment which includes the cable and spool assembly is for retracting the tubular members 68 and where any one of the previously described locking mechanism may be used optionally to lock the tubular members 68 into extended and inclined position. However, the retraction of the tubular members 68 is accomplished with an electric or hydraulic motor 148 which is connected to the spool 80 trough gears 150. One or more swithches 152, only one of which is shown, may control the operation of the motor 148 in accordance with the position of the pivot blocks 74.

Figure 23:
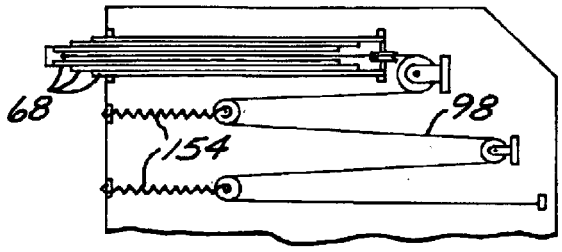
FIG. 23 is a schematic view of a still further embodiment showing an extension spring utilized for retracting the ladder assembly.
Figure 24:
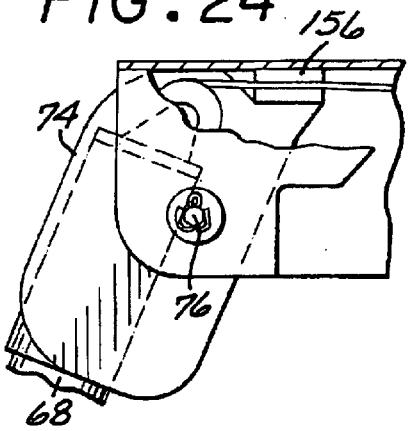
FIG. 24 is a schematic view of a still further embodiment wherein a cable clamp is utilized for locking the ladder assembly into the extended and inclined position.
Figure 25:
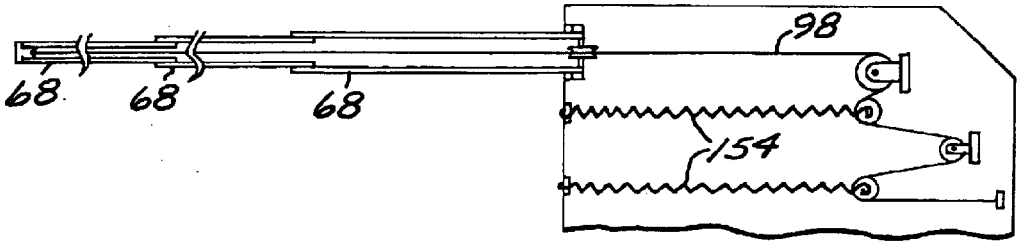
FIG. 25 is a schematic view showing the same embodiment as FIG. 23 with the ladder assembly extended.

The schematic views of FIGS. 23, 24 and 25 disclose still another embodiment of the present invention where tensions springs 154 store the energy provided by a human user (not shown) when the user extends the tubular members 68. This embodiment retains the cable 98 but has no spool. Locking of the tubular members 68 into extended and reclined position is accomplished by one or more cable locks 156 (shown schematically in FIG. 24) which, as in the first preferred embodiment, are controlled by the position of the pivot blocks 74.

Figure 26:
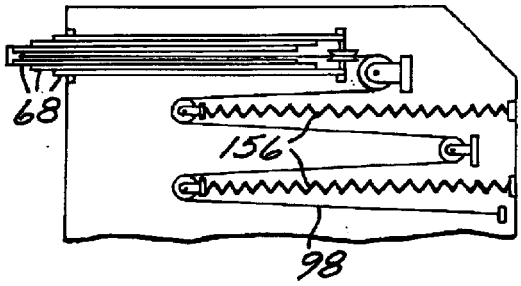
FIG. 26 is a schematic view of still another further embodiment showing compression springs utilized for retracting the ladder assembly.

The schematic view of FIG. 26 discloses yet another embodiment. This embodiment is analogous to the embodiment shown by FIGS. 23, 24 and 25 except that instead of the tension springs 154 compression springs 156 are used to store the energy of the human user (not shown) when the user extends the tubular members 68. The compression springs 156 retract the tubular members 68 when they are no longer in the extended and inclined position. This embodiment also utilizes the pivot blocks 74 and may utilize cable locks 156, or the locking mechanism described in connection with FIG. 19 to lock the extended tubular members 68 into the inclined position.

Figure 27:
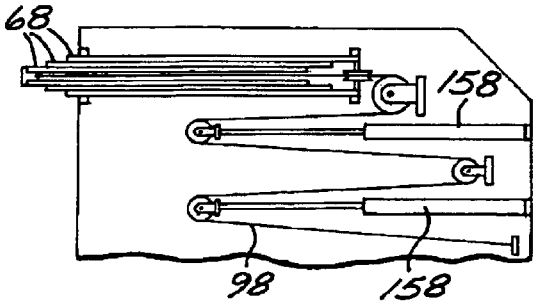
FIG. 27 is a schematic view showing hydraulically operated cylinders for retracting the ladder assembly.

The schematic view of FIG. 27 discloses still another alternative embodiment that retains the cable 98 which interconnects the extended tubular members 68 with the retracting mechanism. In this embodiment the power to retract is provided by one or more hydraulically operated cylinders 158. Switches (not shown) provided in appropriate locations in the assembly may control the operation of the hydraulic cylinders, or the cylinders can be operated manually.

Figure 28:
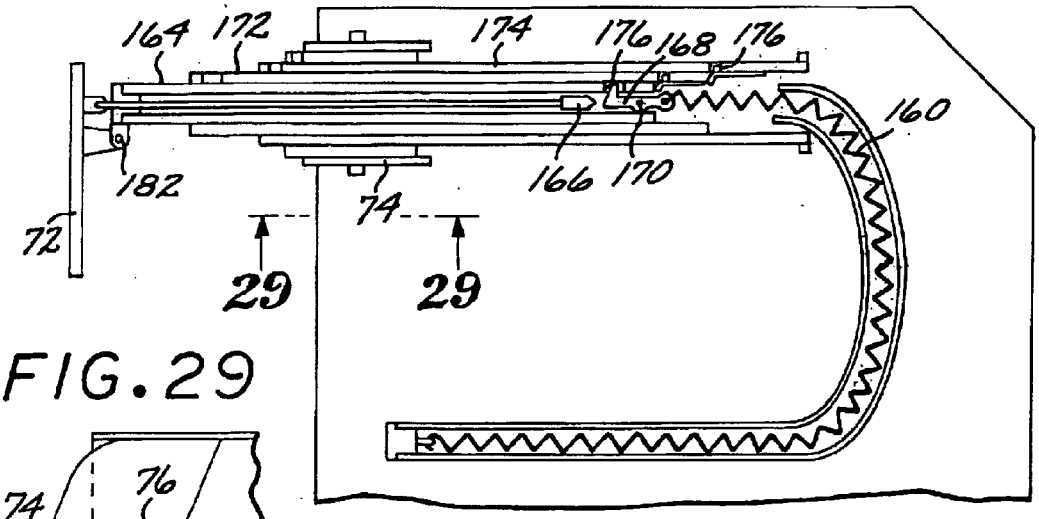
FIG. 28 is a schematic bottom plan view of yet another embodiment of the present invention wherein springs are utilized instead of cables and pulley for retracting the ladder assembly of the present invention.

FIGS. 28 discloses still another embodiment of the present invention. In this embodiment there is no cable and no spool. A tension spring 160 stores the energy which is utilized by the human user (not shown) to extend the ladder assembly. The tension spring 160 also pulls the ladder assembly back into retracted position as described below. This embodiment, similarly to the previously described embodiments, also has three telescoping tubular members. There is a rod 162 in the tube 164 of the smallest diameter and the rod 162 ends in a camming surface 166. A dog 168 is attached on an axle 170 to the smallest tube 164 and the dog 168 cooperates with the camming surface 166 of the rod 162. The tension spring 160 is attached to the dog 168 and as a result the tension spring 160 exerts a pulling force on the smallest tube 164.

Figure 29:
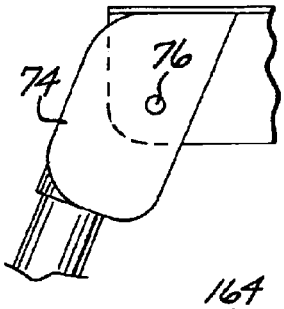
FIG. 29 is a view taken on lines 29,29 of FIG. 28 when the ladder assembly is in extended and inclined position.
Figure 30:
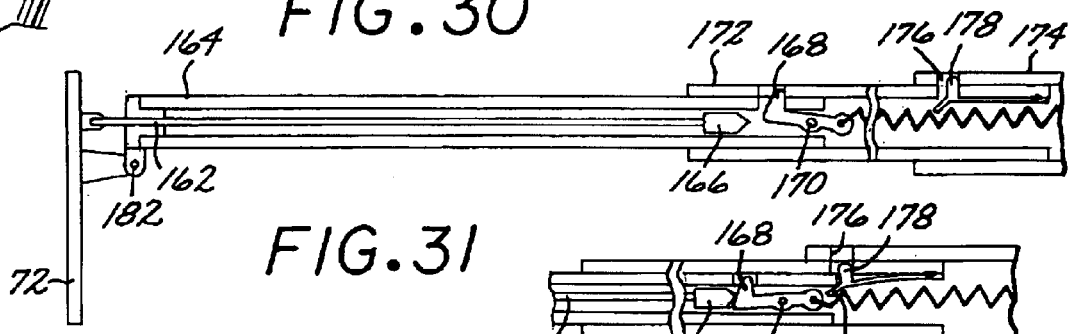
FIG. 30 is a view showing the locking mechanism to keep extended the ladder assembly of the embodiment of FIG. 29.
Figure 31:
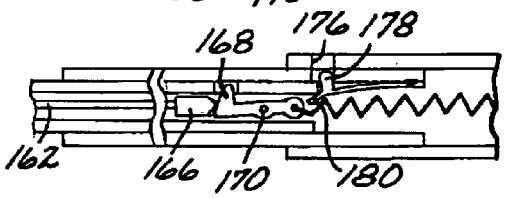
FIG. 31 is a view showing the release of the locking mechanism of the embodiment of FIG. 29.
Figure 32:
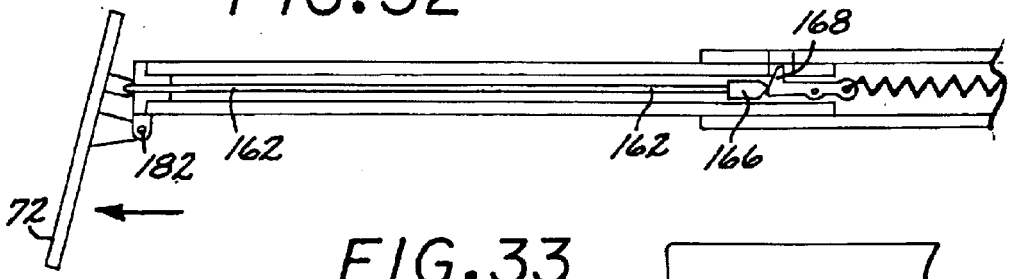
FIG. 32 is a schematic view indicating the release of the locking mechanism by movement of the boat in the water.

The remaining two tubes 172 and 174 include apertures or holes 176 in their interior surfaces and pins 178 which also include a camming surface 180. The pins 178 can enter into the respective holes 176 and in cooperation with the dog 168 keep the ladder assembly in a retracted and inclined position. FIG. 29 shows the pivot blocks 74 which, similarly to the previously described embodiments, make it possible to bend the extended ladder assembly into the inclioned position where the last step 72 (schematically shown) is mounted on an axle 182 to allow some pivoting motion.

It should be readily apparent from the foregoing description and inspection of the drawing figures that when forward motion of the boat 52 creates a tilting force on the step 72 that acts as a hydrofoil, then cam 166 is pushed inward, moves the dog 168 out of the hole 176 and the tension spring 160 retracts the tube 164 of the smallest diameter. The inwardly moving dog 168 then engages the camming surfaces 180 of the respective pins 178 of the two tubes 172 and 174 and removes the pins 178 from the respective holes 176 in the tubes 172 and 174 whereby the entire ladder assembly is retracted.

Still further variations of constructing a step assembly in accordance with the present invention may become readily apparent to those skilled in the art in accordance with the present disclosure. Therefore the scope of the present invention should be determined solely from the following claims, as such claims are interpreted in light of the disclosure and the relevant law and prior art.

What is claimed is:

1. A telescoping self-retracting step assembly for watercraft or boat, comprising:

a ladder comprising a plurality of telescoping members enabling extension and retraction of the ladder, the ladder being attached to a watercraft or boat, the ladder including a surface that can act as a hydrofoil in the water;

means for allowing rotation of the plurality of telescoping members when they are extended into a position where the surface capable of acting as the hydrofoil reaches the water;

means for allowing extension of the ladder by energy supplied by a user for that purpose, said means including a cable attached to at least one of the telescoping tubes and a spool on which the cable is wound;

spring means in operative engagement with the cable and spool for storing the energy used for extending the ladder;

means for temporarily locking the ladder in the extended position wherein the surface that can act as a hydrofoil is in the water, and the spring means being adapted for retracting the ladder by using the stored energy, said retraction being triggered by a change in the angle of the ladder relative to the water, said change being triggered by force of the water on the surface that acts as a hydrofoil when the watercraft or boat moves forward relative to the water, whereby the extended ladder self-retracts when the watercraft or boat moves.

2. The self-retracting step assembly of claim 1 further comprising means for attaching the step-assembly to a swimming platform affixed to a boat.

3. The self-retracting step assembly of claim 2 wherein the means for attaching are adapted for attaching the step assembly to an underside of the swimming platform.

4. The self-retracting step assembly of claim 1 wherein the means for temporarily locking the ladder in the extended position wherein the surface that can act as a hydrofoil is in the water includes a camming surface which is in operative engagement with the spring means, said camming surface acting as means for keeping the ladder in the extended position until the retraction is triggered by a change in the angle of the ladder relative to the water.

5. The self-retracting step assembly of claim 1 wherein the spring means comprise a torsion spring mounted to the spool.

6. The self-retracting step assembly of claim 5 wherein the spring means further comprise a torsion spring mounted to the means for allowing rotation.

7. The self-retracting step assembly of claim 1 wherein the means for temporarily locking includes a recess in the spool and a pin positioned in the the recess and acting as means for preventing rotation of the spool.

8. The self retracting step-assembly of claim 1 wherein the surface capable of acting as a hydrofoil comprises a step attached to one of the telescoping members.

9. A telescoping self-retracting step assembly for watercraft or boat, comprising:

a ladder comprising a plurality of telescoping members enabling extension and retraction of the ladder, the ladder being attached to a watercraft or boat, the ladder including a surface that can act as a hydrofoil in the water;

means for allowing rotation of the plurality of telescoping members when they are extended into a position where the surface capable of acting as the hydrofoil reaches the water, said means including a plurality of pivot blocks;

means for allowing extension of the ladder by energy supplied by a user for that purpose, said means including a cable attached to at least one of the telescoping tubes and a spool on which the cable is wound;

spring means in operative engagement with the cable and spool for storing the energy used for extending the ladder;

means for temporarily locking the ladder in the extended position wherein the surface that can act as a hydrofoil is in the water, said means for temporarily locking the ladder in the extended position including a camming surface which is in operative engagement with the spring means, the spool including a recess and the means for temporarily locking the ladder including a pin positioned in the recess, and the spring means being adapted for retracting the ladder by using the stored energy, said retraction being triggered by a change in the angle of the ladder relative to the water, said change being triggered by force of the water on the surface that acts as a hydrofoil when the watercraft or boat moves forward relative to the water, whereby the extended ladder self-retracts when the watercraft or boat moves.

10. The telescoping self-retracting step assembly of claim 9 wherein the spring means comprise a torsion spring attached to the spool, and wherein the recess is located on the underside of the spool.

11. The telescoping self-retracting step assembly of claim 10 wherein the spring means further comprise a torsion spring acting on the pivot blocks.

12. A telescoping self-retracting step assembly for watercraft or boat, comprising:

a ladder comprising a plurality of telescoping members enabling extension and retraction of the ladder, the ladder being attached to a watercraft or boat, the ladder including a surface that can act as a hydrofoil in the water;

means for allowing rotation of the plurality of telescoping members when they are extended into a position where the surface capable of acting as the hydrofoil reaches the water, said means including a plurality of pivot blocks;

means for allowing extension of the ladder by energy supplied by a user for that purpose, said means including a cable attached to at least one of the telescoping tubes and a spool on which the cable is wound;

spring means in operative engagement with the cable and spool for storing the energy used for extending the ladder;

means for temporarily locking the ladder in the extended position wherein the surface that can act as a hydrofoil is in the water, said means for temporarily locking the ladder in the extended position including a camming surface which is in operative engagement with the spring means, the spool including a recess incorporated on the underside of the spool and the means for temporarily locking the ladder including a pin positioned in the recess, and the spring means comprising a torsion spring attached to the spool and another spring acting on the pivot block the spring means being adapted for retracting the ladder by using the stored energy, said retraction being triggered by a change in the angle of the ladder relative to the water, said change being triggered by force of the water on the surface that acts as a hydrofoil when the watercraft or boat moves forward relative to the water, whereby the extended ladder self-retracts when the watercraft or boat moves.

13. The telescoping self-retracting step assembly of claim 12 further including a plurality of pulleys in engagement with the cable, said pulleys guiding the cable to the spool and to the telescoping tubes.

14. The telescoping self-retracting step assembly of claim 13 wherein said plurality of pulleys include a tensioner pulley forming means for adjusting tension of the cable.

15. A telescoping step assembly for watercraft or boat, comprising:

a ladder comprising a plurality of telescoping members enabling extension and retraction of the ladder, the ladder being attached to a watercraft or boat, the ladder including a surface that can act as a hydrofoil in the water;

means for allowing rotation of the plurality of telescoping members when they are extended into a position where the surface capable of acting as the hydrofoil reaches the water;

means for allowing extension of the ladder by energy supplied by a user for that purpose, said means including a cable attached to at least one of the telescoping tubes and a spool on which the cable is wound;

means for temporarily locking the ladder in the extended position wherein the surface that can act as a hydrofoil is in the water, and motor means being in operative engagement with the cable and spool for retracting the ladder when the watercraft or boat moves forward relative to the water, whereby the extended ladder retracts when the watercraft or boat moves.

16. The telescoping step assembly of claim 15 wherein the motor means are electrically operated.

17. The telescoping step assembly of claim 15 wherein the motor means are hydraulically operated.

18. A telescoping self-retracting step assembly for watercraft or boat, comprising:

a base plate;

a ladder comprising a plurality of telescoping members enabling extension and retraction of the ladder, the ladder being attached to a watercraft or boat, the ladder including a surface that can act as a hydrofoil in the water;

means for allowing the rotation of the plurality of telescoping members when they are extended into a position where the surface capable of acting as the hydrofoil reaches the water;

means for allowing extension of the ladder by energy supplied by a user for that purpose, said means including a cable attached to at least one of the telescoping tubes;

spring means in operative engagement with the cable storing the energy used for extending the ladder, said spring means being affixed to the base plate;

means for temporarily locking the ladder in the extended position wherein the surface that can act as a hydrofoil is in the water, said locking means including a plurality of interfacing camming surfaces, pins and holes in the telescoping members, and the spring means being adapted for retracting the ladder by using the stored energy, said retraction being triggered by a change in the angle of the ladder relative to the water, said change being triggered by force of the water on the surface that acts as a hydrofoil when the watercraft or boat moves forward relative to the water, whereby the extended ladder self-retracts when the watercraft or boat moves.

19. The self-retracting step assembly of claim 18 wherein the means for allowing rotation include a plurality of pivot blocks.

20. The self retracting step assembly of claim 18 where the spring means further comprise a substantially U-shaped tubes and a tension spring, the tension spring being held the U-shaped tube and the U-shaped tube being attached to the base plate.

* * * * *